United States Patent [19]

Forkum, Jr.

[11] Patent Number: 4,916,354

[45] Date of Patent: Apr. 10, 1990

[54] SPARK PLUG FOR INTERNAL COMBUSTION ENGINES

[75] Inventor: Maston Forkum, Jr., Jackson County, Tenn.

[73] Assignee: C. Earl Johnson, Winter Haven, Fla.

[21] Appl. No.: 221,733

[22] Filed: Jul. 20, 1988

[51] Int. Cl.[4] ..... H01T 13/32

[52] U.S. Cl. ..... 313/141; 313/140

[58] Field of Search ..... 313/140, 141, 142

[56] References Cited

U.S. PATENT DOCUMENTS

| | | | |
|---|---|---|---|
| 2,487,535 | 11/1949 | Fernandez | 313/141 X |
| 2,894,162 | 7/1959 | Ignatjev | 313/141 |
| 4,268,774 | 5/1981 | Forkum, Jr. | 313/141 |

*Primary Examiner*—Kenneth Wieder

*Attorney, Agent, or Firm*—Pitts and Brittian

[57] ABSTRACT

A spark plug configuration having improved operational characteristics to achieve a greater efficiency in internal combustion engines. The ground electrode of the spark plug is configured to have two equal width prongs that diverge from each other in a uniform manner from a point that is substantially on the projection of the periphery of the center electrode. At least one of those prongs is redirected in its outer portion so as to be directed toward the other prong. This redirected portion begins substantially along a projection of the periphery of the center electrode such that the terminal or free end of the prong extends beyond the extension of this periphery. In a second embodiment, the second prong is also redirected at an outer portion toward the first prong such that a completely symmetrical mirror-image prong is formed about a plane passing through the axis of the center electrode and the vertex. This configuration causes a uniform distribution of the spark in the spark gap and thereby increases the efficiency of the ignition of a fuel mixture in an internal combustion engine. A substantially cylindrical surface at the vertex more uniformly directs current of the spark in both prongs.

12 Claims, 1 Drawing Sheet

SPARK PLUG FOR INTERNAL COMBUSTION ENGINES

DESCRIPTION

1. Technical Field

The present invention relates generally to spark plugs for igniting the fuel charge in an internal combustion engine, and more particularly to an improved spark plug ground electrode construction which improves gasoline mileage, diminishes exhaust pollution, and reduces carbon build-up.

2. Background Art

Conventional internal combustion engine spark plugs, which are in widespread use, utilize a single ground electrode that extends from the base of the spark plug and is bent at substantially right angles to that base portion so as to cover the end of an axial high tension electrode. A spacing between the ground electrode and the center electrode is maintained and it is across this spacing or gap that a spark is produced for the ignition of a fuel charge. Although such spark plugs have generally worked satisfactorily, there has been a continuing need for a plug which increases the ignition efficiency, decreases the pollution emission of the engine, and resists fouling by the various deposits produced during the ignition of the fuel charge.

Various spark plug constructions have therefore been proposed and constructed in an effort to improve engine and plug performance. Two such spark plugs are shown and described in U.S. Pat. Nos. 2,889,555 and 2,894,162. In the latter of these patents, for example, the ground electrode is constructed with two parallel spaced apart end portions arranged on opposite sides of the center electrode axis. These portions, at a position remote from their free ends, join with a V-shaped portion lying remotely from the peripheral limits of the center electrode and then are connected to the shell of the spark plug in a conventional manner.

Still another spark plug that was designed to accomplish similar results is that shown and described in my U.S. Pat. No. 4,268,774, issued on May 19, 1981. In this patent, the ground electrode is forked so as to produce two prongs or legs. These prongs diverge continuously away from each other throughout their entire length from a vertex located adjacent to the peripheral edge of the center electrode. The spark plug of this patent, and of the above-cited patents, is intended to redirect the spark that is created between the center electrode and the ground electrode to modify the ignition of the fuel charge to accomplish the improved results.

With the ever increasing demands for engine efficiency and the lowering of pollutants, it has been found that the conventional spark plug, as well as the above-identified improved spark plugs, do not meet the current challenge for operation.

Accordingly, it is a principal object of the present invention to provide a spark plug which exhibits an improved efficiency in the combustion of fuel charges in an internal combustion engine.

It is a further object of the present invention to provide a spark plug having a singular ground electrode for simplicity of construction, the ground electrode being configured to improve the transfer of the spark between the center electrode and the ground electrode to accomplish the increase in fuel efficiency.

It is a further object of the present invention to provide an improved ground electrode configuration for spark plugs used in internal combustion engines with this ground electrode configuration effecting uniform spark distribution around the center electrode such that increased electrode life is achieved as well as an increased efficiency of the spark in the combustion of a fuel charge.

These and other objects of the present invention will become apparent upon the consideration of the following description with reference to the drawings referred to therein.

DISCLOSURE OF THE INVENTION

According to the present invention, there is provided a singular ground electrode for a spark plug used in an internal combustion engine, wherein the ground electrode is divided into two equal portions at or near a point on the projection of the periphery of the center electrode, with the portions diverging from each other in a uniform manner, and with at least one of the portions near its free end being redirected toward, but not contacting, the other of the portions.

BEST MODE FOR CARRYING OUT THE INVENTION

Figure 1:
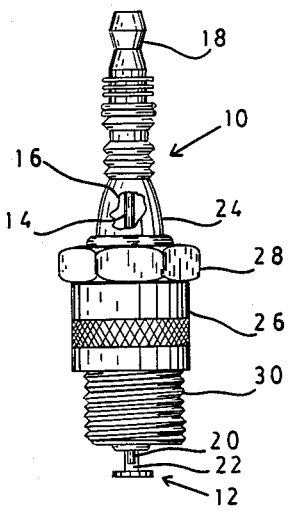
FIG. 1 is a front elevation of a spark plug incorporating the principles of my invention.
Figure 2:
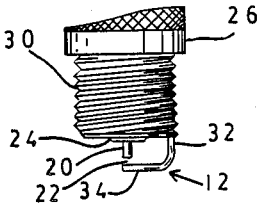
FIG. 2 is a fragmentary side elevation of the plug shown in FIG. 1.

Referring first to FIGS. 1 and 2, shown therein is what appears to be a substantially conventional spark plug 10. It is conventional except for the ground electrode configuration 12 which is described in detail hereinafter. The conventional portions of the spark plug include a center electrode 14, as viewed through the cutaway identified at 16. This center electrode terminates at one end with a cap 18 suitable for the attachment of a spark plug wire (not shown). The opposite end of the center electrode 14 terminates in the spark gap region with an end 20, such that a spark gap 22 exists between the end 20 and the ground electrode 12. In a conventional manner, an insulator 24 surrounds the center electrode 14 throughout essentially its entire length with this ceramic insulator 24, in turn, being surrounded by a metal cap 26 having a wrench-engaging portion 28 and a reduced and threaded portion 30. The length and diameter of the various components as well as the pitch of the threads are selected for a particular manufacturer of plugs for various uses thereof.

Referring now specifically to FIG. 2, it may be seen that the ground electrode 12 is formed with at least two components. There is a downwardly depending portion 32 which is substantially parallel with the axis of the center electrode 14. The ground electrode is then bent at substantially right angles to produce a portion 34 which projects toward and slightly beyond the most distant periphery of the center electrode 14. This portion 34 lies in a plane substantially perpendicular to the axis of the center electrode. It is the configuration of this portion 34 which makes up the present invention.

Figure 3:
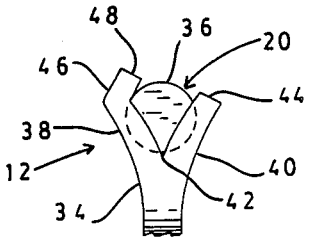
FIG. 3 is an enlarged fragmentary end view of the spark plug of FIG. 1 and FIG. 2 showing one embodiment of the split ground electrode thereof.

One embodiment of the ground electrode configuration of the present invention is illustrated in FIG. 3. In this figure, the numeral 36 is used to designate the periphery of end 20 of the center electrode 14. In this figure it may be seen that the portion 34 of the ground electrode 12 is divided into two equal width prongs 38 and 40 that are separated from each other beginning at a vertex point 42. It may be seen that these two prongs 38 and 40 diverge uniformly from a plane that could be drawn between the axis of the center electrode 14 and the vertex 42, with this vertex 42 being positioned substantially along a projection or extension of the periphery 36 of the center electrode end 20. Prong 40 continues in a straight diverging manner terminating in a free end 44. This free end is positioned outside of the extension of the periphery 36. The second prong 38, at a point substantially on a projection of the periphery 36, has a further portion 46 that is directed toward prong 40, and this redirected portion terminates in a free end 48 beyond the extension of the periphery 36. This provision of the redirected portion 46 of prong 38 has been found to increase the efficiency of a spark generated between the center electrode end 20 and the ground electrode 12, and thereby achieve increased performance of an internal combustion engine in which this improved spark plug is utilized.

The configuration shown in this FIG. 3 is accomplished by using a stamping technique whereby the ground electrode 34 is split into the two equal prongs, and thereafter the portion 46 is bent toward the center electrode into the configuration as shown so that the free ends 44 and 48 project substantially the same distance outside of the extension of the periphery 36. The prong 40 may require a reduction in length for this equal projection and this can be accomplished during the stamping action. Fabrication by a stamping operation is preferred in that no metal is lost during the formation thereby reducing the cost of producing a spark plug of the configuration of the present invention. Furthermore, a jig for accomplishing this formation produces a closer tolerance than a sawing operation and subsequent shaping. It is, for example, much easier to achieve identical and uniform width of the prongs by stamping rather than using a sawing operation.

Figure 4:
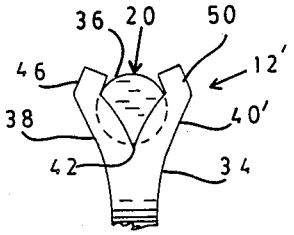
FIG. 4 is an enlarged fragmentary view of another embodiment of the ground electrode useful in the spark plug of FIGS. 1 and 2.

Another embodiment of the present invention is illustrated in FIG. 4. In this embodiment, the portion 34 of the ground electrode 12' is, as shown in FIG. 3, divided into two equal width prongs which diverge from a vertex point 42. Prong 38 of this pair is provided with a redirected portion 46 in the same manner as is shown in FIG. 3. In addition, prong 40' is also formed with a redirected portion 50 that is substantially identical to the redirected portion 46 except that it is directed toward the opposite prong. This redirected portion 50 begins at substantially an extension of the periphery 36 so portion 34 are substantially identical. With a ground electrode configured as shown, further improvement in the operation of the spark plug is accomplished.

Figure 5:
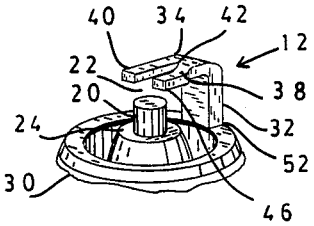
FIG. 5 is a perspective view of the gap defining end of the spark plug of FIGS. 1 and 2 showing the embodiment of FIG. 3.

A perspective view of the spark generating region of the spark plug is illustrated in FIG. 5. This particular drawing illustrates the ground electrode configuration of FIG. 3. In this drawing, the relationship of the insulator 24 and the end 20 of the central electrode 14 is clearly visible together with the spark gap region 22. In a typical construction of a spark plug, the ground electrode 12 is initially a straight member having one end portion welded to the metal cap portion 30 as at 52. Thereafter, it is configured as illustrated in those drawings: first by forming the prongs of appropriate configuration, and then by bending to form the spark gap.

Figure 6:
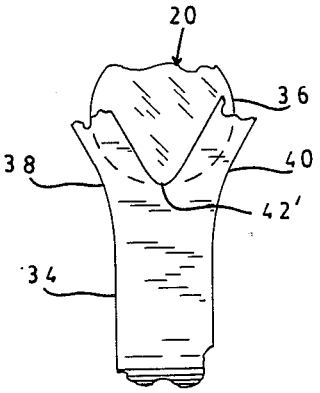
FIG. 6 is an enlarged fragmentary view of the ground electrode of the present invention showing an improved juncture of the two prongs thereof.

Another embodiment of the ground electrode of the present invention is shown in the fragmentary view of FIG. 6. The vertex 42' of this embodiment is a cylindrical surface contour formed during the stamping operation. This contour has a geometric center along an axis substantially parallel with the axis of the center electrode 14. The radius of curvature of this surface is generally about 1 millimeter or less. It has been found that by providing this cylindrical surface, the spark progresses more uniformly along each of the prongs and thereby is of further improvement in the operation of the spark plug of the present invention.

From the foregoing, it may be seen that an improved spark plug configuration with enhanced operating characteristics has been achieved. Although only certain specific embodiments are described herein, it will be recognized by persons versed in the art that the teachings contained herein will permit the fabrication of other spark plugs which will perform as described. Accordingly, this invention is limited only by the claims that are appended hereto and their equivalents.

I claim:

1. A spark plug for igniting a fuel charge within an internal combustion engine, which comprises:

a metal housing which is provided with external threads for threadable engagement with such engine;

an elongated insulator, having a central axis and carried by said housing, said insulator having a first end to extend within such engine, and a second end;

an elongated central electrode along said central axis of said central insulator, said central electrode having a first end with a peripheral surface extending beyond said first end of said insulator to define a first surface of a spark gap, and a second end extending beyond said second end of said insulator for connection to a voltage source for spark initiation; and a ground electrode having a first portion connected to said housing and extending therefrom substantially parallel to said central electrode, and a second portion extending from said first portion in a plane substantially perpendicular to said central axis to define a second surface of said spark gap, said second portion of said ground electrode being divided into two equal width substantially linear prongs terminating in free ends, said prongs being joined at a vertex and initially diverging uniformly from each other and linearly from said vertex, with at least one of said prongs being redirected toward the other of said prongs proximate said free ends whereby said spark is created first between said central electrode and said vertex, and caused to travel along both of said diverging prongs, forming and maintaining, by means of the reconverging free ends and said equal width and linear shape of said prongs, a spark of increased area, burning the fuel more efficiently.

2. The spark plug of claim 1 wherein both of said prongs are redirected toward each other proximate said free ends, both of said prongs being in said plane substantially perpendicular to said central axis.

3. The spark plug of claim 1 wherein said vertex is located substantially on a projection from said peripheral surface of said central electrode closest to said first portion of said ground electrode.

4. The spark plug of claim 1 wherein said free ends of said prongs terminate external to a projection from said peripheral surface of said central electrode on a side opposite said first portion of said ground electrode.

5. The spark plug of claim 1 wherein said prongs initially diverge equally from a plane containing said vertex and said central axis.

6. The spark plug of claim 1 wherein said vertex is provided with a substantially cylindrical surface, with a center for creating said cylindrical surface being parallel with said central axis.

7. A spark plug for achieving an efficient ignition of a fuel charge within an internal combustion engine, which comprises:

a metal housing which is provided with external threads for threadable engagement with such engine;

an elongated insulator, having a central axis and carried by said housing, said insulator having a first end to extend within such engine, and a second end;

an elongated central electrode along said central axis of said insulator, said central electrode having a first end with a peripheral surface extending beyond said first end of said insulator to define a first surface of a spark gap, and a second end extending beyond said second end of said insulator for connection to a voltage source for generation of a spark in such spark plug; and a ground electrode having a first portion connected to said housing and extending therefrom substantially parallel to said central electrode, and a second portion extending from said first portion in a plane substantially perpendicular to said central axis to define a second surface of said spark gap said second portion of said ground electrode being divided into two substantially linear prongs of equal width terminating in free ends, said linear prongs being joined at a vertex positioned substantially on a projection of said peripheral surface of said center electrode and initially diverging equally from each other and linearly from a plane containing said central axis and said vertex, with at least one of said prongs being redirected toward the other of said prongs proximate said free end of said prong wherein each of said prongs lies in said plane of said ground electrode substantially perpendicular to said central axis whereby said spark is created first between said central electrode and said vertex, and caused to travel along both of said diverging prongs, forming and maintaining, by means of the reconverging free ends and said equal width and linear shape of said prongs, a spark of increased area, burning the fuel more efficiently.

8. A spark plug for achieving an efficient ignition of a fuel charge within an internal combustion engine, which comprises:

a metal housing which is provided with external threads for threadable engagement with such engine;

an elongated insulator, having a central axis and carried by said housing, said insulator having a first end to extend within such engine, and a second end;

an elongated central electrode along said central axis of said insulator, said central electrode having a first end with a peripheral surface extending beyond said first end of said insulator to define a first surface of a spark gap, and a second end extending beyond said second end of said insulator for connection to a voltage source for generation of a spark in said spark gap of such spark plug; and a ground electrode having a first portion connected to said housing and extending therefrom substantially parallel to said central axis, and a second portion extending from said first portion in a plane substantially perpendicular to said central axis to define a second surface of said spark gap, said second portion of said ground electrode being divided into two equal width substantially linear prongs terminating in free ends, said prongs being joined at a vertex substantially on a projection from said peripheral surface of said central electrode and each prong initially diverging uniformly and substantially linearly from each other, from said vertex, and from a plane through said vertex and said central axis, with said prongs being equally directed toward each other proximate said free ends beginning at a point substantially along a projection from said peripheral surface of said central electrode such that said free ends extend beyond said extension of said peripheral surface with both prongs lying in said plane of said ground electrode substantially perpendicular to said central axis and whereby said spark is created first between said central electrode and said vertex, and caused to travel along both of said diverging prongs, forming and maintaining, by means of the reconverging free ends and said equal width and linear shape of said prongs, a spark of increased area, burning the fuel more efficiently.

9. The spark plug of claim 7 wherein said vertex is provided with a substantially cylindrical surface, with the center for creating said cylindrical surface being parallel with said central axis.

10. The spark plug of claim 8 wherein said vertex is provided with a substantially cylindrical surface, with the center for creating said cylindrical surface being parallel with said central axis.

11. The spark plug of claim 9 wherein said cylindrical surface has a radius of curvature of about 1 millimeter or less.

12. The spark plug of claim 10 wherein said cylindrical surface has a radius of curvature of about 1 millimeter or less.

* * * * *